US005166461A

United States Patent [19]

Salwitz et al.

[11] Patent Number: 5,166,461

[45] Date of Patent: Nov. 24, 1992

[54] HARMONICAS

[76] Inventors: Richard D. Salwitz, 333 Commonwealth Ave., Boston, Mass. 02115; Pierre G. T. Beauregard, IV, P.O. Box 275, West Groton, Mass. 01472

[21] Appl. No.: 250,771

[22] Filed: Sep. 28, 1988

[51] Int. Cl.[5] ..... G10D 7/12

[52] U.S. Cl. ..... 84/377

[58] Field of Search ..... 84/377, 378

[56] References Cited

U.S. PATENT DOCUMENTS

| | | | |
|---|---|---|---|
| 863,960 | 8/1907 | Yates | 84/377 |
| 1,735,645 | 11/1929 | Hostetter | 84/377 |
| 2,276,501 | 3/1942 | Manieri | 84/377 |
| 2,511,302 | 6/1950 | Stephenson | 84/377 |

FOREIGN PATENT DOCUMENTS 3021610 12/1981 Fed. Rep. of Germany ..... 84/377

*Primary Examiner*—W. B. Perkey

*Assistant Examiner*—Cassandra C. Spyrou

[57] ABSTRACT

Harmonics are disclosed in which the pitches of the draw-reeds and blow-reeds are arranged such that, in each of at least seven successive cavities, the pitch of the blow-reed is equal to or lower than that of the draw-reed. Disclosed harmonicas also feature reeds of three or four adjacent cavities arranged to enable them to produce all twelve notes of the chromatic scale, or provide reed arrangements in which a major or minor chord of the draw key-note is repeated by draw-reeds in successive sets of cavities, and in which at least four adjacent cavities produce an extended chord of the blow key-note. In many disclosed harmonicas, the blow-reed in each cavity is lower in pitch than the draw-reed.

40 Claims, 12 Drawing Sheets

HARMONICAS

FIELD OF INVENTION

This invention relates to harmonicas.

BACKGROUND OF INVENTION

Two principal types of harmonicas are the simple harmonica (which typically consists of eight or ten holes or cavities each of which can produce two notes, one draw-note and one blow-note), and the slide chromatic harmonica (which consists, in effect, of two separate simple harmonicas, one above the other). In slide chromatic harmonicas, one instrument is tuned a half-step higher than the other and the user switches from one to the other by depressing or releasing a movable slide.

Both types of harmonicas are available in twelve different keys, but for each key the progression of notes is generally the same. The standard arrangement of notes for a ten cavity simple harmonica is shown in FIGS. 1 and 2; that of two "simple harmonicas" in a typical slide chromatic harmonica is somewhat different.

In each cavity of the simple harmonica of FIGS. 1 and 2, the pitch of the draw- or blow-reeds is higher than that of the corresponding reed in the cavity to the left, and lower than that of the corresponding reed in the cavity to the right. Exhaling or blowing across any three adjacent holes of any of three sets of cavities (i.e., the first through third, fourth through sixth and seventh through ninth cavities) will produce a major triad (1-3-5) of the blow key-note (typically the note of the blow-reed of the first cavity, F in FIG. 1). The chord of the fourth through sixth cavities is one octave higher, and that of the seventh through ninth cavities is two octaves higher, than that of the first through third cavities. The seventh chord (1-3-5-$^{b}$7) of the draw key-note (typically the note of the draw-reed of the second cavity, C in the harmonica of FIG. 1), is produced by inhaling or drawing across the key-note cavity and the next three adjacent cavities (i.e., by drawing on the second through fifth cavities).

The simple harmonica of FIGS. 1 and 2 was originally designed to play European folk songs in the "blow mode," and an arrangement which produced the major triad chord of the blow key-note (the "blow" chord) and a dominant seventh chord of the blow- key-note (the "draw" chord) was satisfactory. These were the only two chords produced, however, and this arrangement has limited the types of music that may be played on the instrument.

Around the 1920's, the playing perspective and orientation began to focus on the "draw mode," in which songs were played in the key of the draw chord instead of that of the blow chord. There were a number of advantages to the "draw mode" approach.

One principal advantage was that blues and boogie woogie, popular at the time, played easily in the "draw mode"; they are based on the mixolydian scale which was most easily played in the draw key and features the flat seventh ($^{b}$7) of the scale, the primary "blue note." A second advantage is that, because of the "bending principle" discussed below, the draw reeds in the first through sixth cavities could be "bent down" in pitch; "bending" has become a hallmark of blues and modern playing. Because it is more expressive, the "draw mode" has prevailed in modern harmonica playing to the present day. However, the available harmonica instruments have placed considerable restrictions on the notes and chord progressions available.

U.S. Pat. No. 4,237,766 to Marshall discloses harmonicas having somewhat different arrangements which enable playing a few chords not generally available in traditional harmonicas, but each blow-note arrangement is such that any three adjacent holes produce the same major (1-3-5), minor (1-$^{b}$3-5), or diminished (1-$^{b}$3-$^{b}$5) triad of the blow key-note, and the only chord produced by the draw-notes is a major seventh, a minor seventh, or a diminished seventh flatted ninth chord of the draw key-note.

SUMMARY OF THE INVENTION

The present invention provides harmonica structures which increase the number of chord progressions (and their voicings) that may be played, produces chords and notes not heretofore available, and makes it possible to provide harmonicas which are uniquely adapted to playing, and accompanying, many diverse types of music, e.g., jazz, soul, blues, ragtime, Mexican, Arabian, etc. The invention also makes it possible to provide harmonicas that, without requiring the two-simple-harmonicas-and-a-slide structure of the past, are fully chromatic.

In one major aspect, the invention features a harmonica in which the pitches of the draw-reeds and blow-reeds are arranged such that, in each of at least seven successive cavities, the pitch of the blow-note is equal to or lower than that of the draw-note; by way of contrast, in each of the conventional and Marshall patent harmonicas described above, the blow-notes are lower in pitch for only six successive (e.g., the first six) cavities.

Other aspects of the invention feature harmonicas in which the reeds of three or four adjacent cavities are arranged to enable them to produce all twelve notes of a chromatic scale (i.e., 1, $^{b}$2, 2, $^{b}$3, 3, 4, $^{b}$5, 5, $^{b}$6, 6, $^{b}$7 and $^{M}$7), in which a chord of the draw key-note is repeated by draw-notes in successive sets of cavities, and in which at least four adjacent cavities produce an extended chord (1-3-5-x or 1-$^{b}$3-5-x) of the blow key-note.

In preferred embodiments which include a number of these aspects, the blow-reed is lower in pitch than the draw-reed in each of the harmonica cavities.

In describing both the prior art and the present invention, the term "chord" means a group of at least three notes of successively higher pitch in which the interval between the first (the key-note) and second notes, and that between the second and third notes, is either 1½ or 2 steps. If the interval between the first two notes is 1½ steps, the chord is either a "minor" chord (if the interval between the second and third notes is 2 steps) or a "diminished" chord (if the interval between the second and third notes is 1½ steps). If the interval between the first and second notes is 2 steps, the chord is either a "major" chord (if the interval between the second and third notes is 1½ steps) or an "augmented" chord (if the interval between the second and third notes is 2 steps). The term "chord" also includes extended chords which include a fourth note higher in pitch (typically by 1, 1½ or 2 steps) than the third note.

In the prior art, even though there are two keys (chords) available, the "key" of the harmonica normally has been designated by the key-note of the "blow"

chord, i.e., the note lowest in pitch and found in the lowest (left-most) "blow" cavity (hole 1 in FIG. 1).

In the present invention, the key of the harmonica is designated by the key-note of the "draw" chord. Depending on the particular embodiment and its "draw" chord voicing, the key-note can be located in the first, second, third, or even the fourth cavity of the harmonica. For example, the key-note (1), draw chord (1-3-5-6), and note progression of the harmonicas of FIGS. 15–18 are all the same, but the voicing of the four harmonicas is different—the key-note is in the first cavity of the harmonica of FIG. 15, in the second cavity of the harmonica of FIG. 16, in the third cavity of the harmonica of FIG. 17, and in the fourth cavity of the harmonica of FIG. 18.

DETAILED DESCRIPTION

Figure 1:
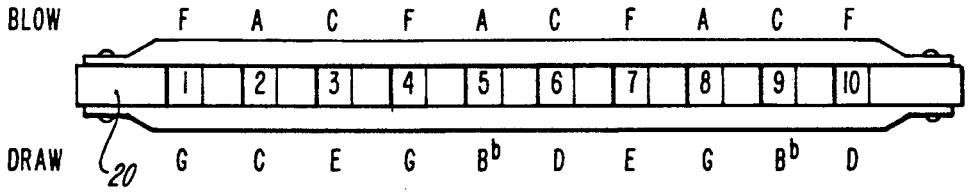
FIG. 1 (PRIOR ART)
FIG. 1 illustrates a conventional ten-cavity harmonica.

Referring first to FIG. 1, there is illustrated a conventional harmonica, generally designated 20, having ten aligned holes or cavities, designated 1–10. Two conventional reeds (not shown) are associated with each cavity such that one reed is responsive to blowing air into the cavity and the other is responsive to drawing air from it. Each reed is constructed so that it produces a musical note or tone of a certain predetermined pitch. The notes indicated along the upper portion of FIG. 1 are those produced by blowing into the respective hole and are termed blow-notes; those indicated along the lower portion of FIG. 1 are produced by drawing from the respective cavity and are termed draw-notes.

The harmonica 20 of FIG. 1 is tuned in the key of F when viewed from a blow perspective (i.e., the pitch of the key-note blow-reed, in the first cavity, is F and the chord produced by the blowing across the first three cavities, and also across the fourth through sixth and seventh through ninth cavities, is the F major triad, i.e., the F-A-C (1-3-5) or F major chord. Viewed from a draw perspective harmonica 20 is tuned in the key of C, i.e., the pitch of the key-note draw-reed, in the second cavity, is C and the chord produced by drawing across the 2nd–5th cavities is the C seventh (C-E-G-$^{b}$B, or 1-3-5-$^{b}$7) chord.

It will, or course, be evident, that harmonica 20 (and any other harmonica) may be tuned in any one of the twelve conventional keys. The pitch of the various draw-notes and blow-notes will vary depending on the particular key chosen; but for any particular arrangement, no matter what the key, the relationship between the pitches of the notes will remain the same. Accordingly, notes and chords of the harmonicas of the prior art and of the present invention hereinafter are identified and discussed in terms of their scalar relation to the key-notes of the draw-reeds and blow-reeds, rather than being identified and discussed in terms of any particular pitch.

Figure 2:
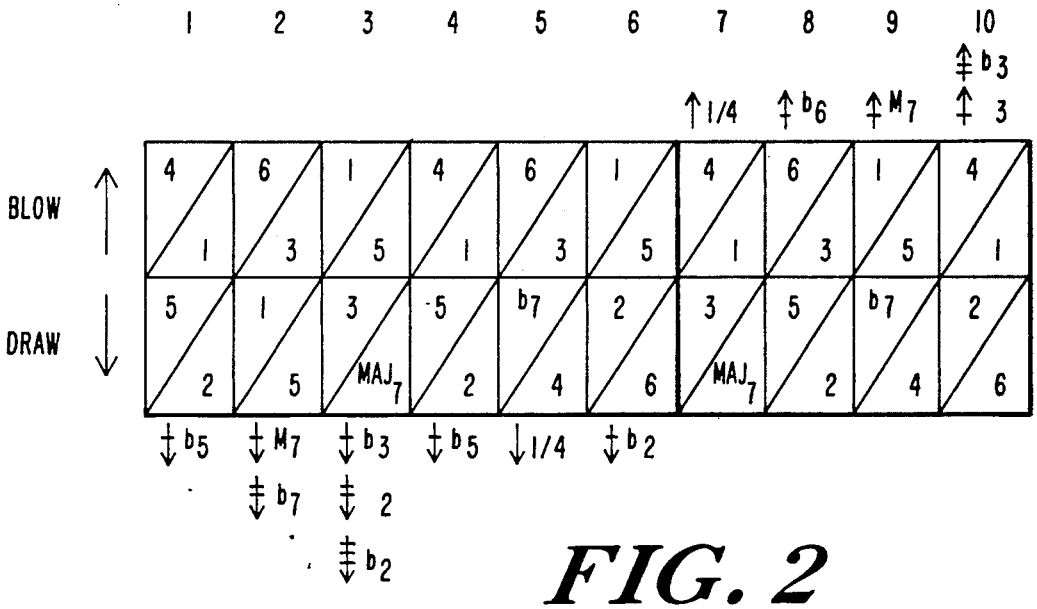
FIG. 2 (PRIOR ART)
FIG. 2 schematically illustrates the note arrangement of the conventional harmonica of FIG. 1.

For example, FIG. 2 schematically illustrates the relative pitches of the draw-reeds and blow-reeds of the cavities of the simple ten hole harmonica shown in FIG. 1. In FIG. 2, the numbers across the top of the two rows of boxes identify the ten cavities of the harmonica, the top row of "boxes" represents the blow-notes of each of the ten cavities, and the bottom row of "boxes" represents the draw-notes. Each box is diagonally divided into two portions. The number in the upper left portion of each box indicates the pitch of the particular reed in relation to the draw key-note of the harmonica (i.e., to the key-note of the lowest pitched chord available on the draw-reeds), and the number in the lower right portion of each box indicates the pitch of the same reed relative to the harmonica's blow key-note (i.e., to the key of the lowest pitched chord produced by the blow-reeds).

Thus, and by way of further explanation, viewed from a "blow" perspective the key-note of the conventional instrument shown in FIGS. 1 and 2 is produced by the blow-reeds in the first, fourth, seventh and tenth cavities (as shown by the 1's in the lower right hand portions of the respective boxes in the upper row). The blow-reeds will produce major triads (the 1-3-5 chords) of the blow key-note (again as shown by the numbers in the lower right hand portions of the upper row "blow-note" boxes) in three octaves, and the draw-reeds will produce the 2, 4, 5, 6, and $M^7$ notes of the blow- key-note scale.

Viewed from a "draw" perspective, the key-note of the instrument is produced by the draw-reed in the second cavity (as shown by the "1" in the upper left hand portion of the second box in the lower "draw-note" row of boxes. The draw-reeds in the second through fifth cavities will produce a seventh chord (the 1-3-5-$^{b}$7 chord, as shown by the numbers in the upper left hand portions of the second through fifth cavities in the lower row of boxes); and the blow-reeds will produce the 1, 4, and 6 notes (and 4-6-1 chords) of the draw- key-note scale.

FIG. 2 also indicates the extent to which it is possible for a player to "bend" the reeds in different cavities. The "bending" of pitches is commonly done in the playing of many instruments and is one of the cornerstones of modern harmonica playing. "Bending" enables a musician to play notes other than those provided by the normal pitch of the various reeds, and thus can increase the number of notes (different pitches) playable on the instrument. In some harmonicas of the present invention, "bending" provides all the semi-tones missing in the normal-pitch reeds, and (without a slide) makes the instrument fully chromatic.

Physically, the player produces the "bent" notes by increasing wind pressure while simultaneously changing the size and shape of the throat and mouth cavities thus lowering the pitch of the fundamental (or fixed) pitch of the reed. Bent notes are always lower than the fixed pitches from which they are derived. In a harmonica, with a "blow and draw" configuration, the higher pitched of the two reeds in any cavity or hole is the one affected by the bending process and produces the "bent" note(s). The higher pitched reed in a particular cavity can be "bent" to produce lower pitched notes, i.e., notes which are lower in pitch over a continuous range from the fixed pitch of the higher pitched reed to (but not below) the fixed pitch of the other (lower pitched) reed in the cavity. The lower pitched reed in the cavity cannot be bent. Depending on the interval between the two reeds, it may be possible to bend the higher pitched reed to produce three or four lower pitched "bent" notes. All pitches between the pitches of the blow and draw-reed can be produced by "bending"

the higher pitched reed, thus enabling the harmonica player to produce many other notes in addition to the twenty (typically) fixed notes provided by the predetermined pitches of the ten blow and ten draw-reeds.

The heavy vertical line between the sixth and seventh cavities in FIG. 2 denotes a "switchover" line. In each of the cavities to the left of the line, i.e., the first six cavities, the draw-reed can bend since it is higher in pitch than the blow-reed; to the right of the line, i.e., the seventh through tenth cavities, the blow-reed in each cavity is of the higher pitch and it, rather than the draw-reed, can bend. The arrows above or below the respective cavities indicate the extent of bending possible, i.e., what notes between the pitch of the draw-reed and the pitch of the blow-reed may be played. As will be evident, an arrow with one line through it indicates bending a half-step, an arrow with two lines through it indicates bending one full step (2-half steps) and an arrow with three lines through it indicates bending 1½ steps (3 half steps). The number next to each arrow indicates the pitch of the "bent" note in relation to the draw keynote; if the reed bends only a quarter-tone, that fact is stated explicitly.

By way of example, and with reference to both FIGS. 1 and 2, it will be noted that the pitch of the draw-reed of the third cavity is E, while the pitch of the lower pitched blow-reed in the same cavity is C. The difference between the pitches of the two reeds is 2 whole steps (in the nomenclature of FIG. 2, the pitch of the draw-reed in the third cavity is 3 and that of the blow-reed is 1); and it is thus possible to "bend" the draw-reed one half step (to $^b$3 or E flat), 1 step (to 2 or D) or 1½ steps (to $^b$2 or D flat). Similarly, in the tenth cavity the pitch of the blow-reed is F (or 4 in the nomenclature of FIG. 2), 1½ steps higher than that of the draw-reed which is D (2 in the nomenclature of FIG. 2); and it thus is possible to "bend" the blow-reed in the tenth cavity down in pitch ½ step to E (or 3) and down 1 step to E flat (or $^b$3).

Reference is now made to FIGS. 3–35, each of which shows schematically, in the same manner as FIG. 2 except that arrows indicating the extent of bending of the blow-reeds have been omitted, a harmonica constructed in accord with the present invention. As in prior art harmonicas, the pitch of the reeds in the cavities increases from left to right. Except in a few instances in which the same blow- or draw-note occurs in two adjacent cavities (e.g., the same blow-note is in the sixth and seventh cavities in the harmonica of FIG. 30), when the same numbered pitch is shown more than once in a row of blow-notes or in a row of draw-notes, the pitch of the note in a higher-numbered cavity is one octave higher than is the most adjacent same numbered pitch in a lower-numbered cavity.

Figure 3:
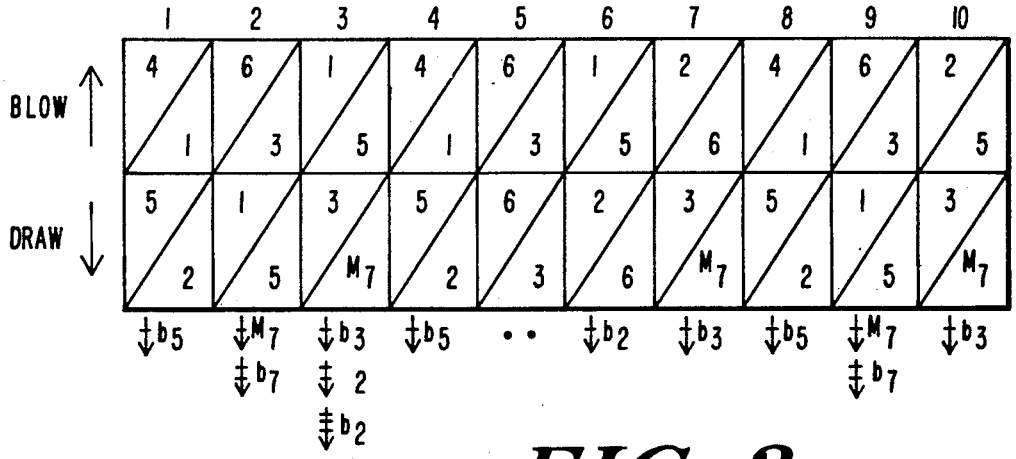
FIGS. 3–35 schematically illustrate the note arrangements of harmonicas constructed in accord with the present invention.

Referring to FIG. 3, it will be seen that a number of reeds (i.e., the blow-reeds in the seventh through tenth cavities and the draw-reeds in the fifth, ninth and tenth cavities) have a different pitch relative to the draw and blow key-notes than in the conventional arrangement of FIG. 2. As a result of these changes, the blow-reed in each cavity is lower (or in the case of the fifth cavity equal) in pitch to the draw-reed, and the draw-reeds in cavities seven through ten will "bend." Additionally, and again unlike the conventional harmonica, the blow-reeds will produce an extended chord (the 1-3-5-6 chord of the blow key-note), and this same new chord is provided, lower in pitch and in the draw-notes key, by the draw-reeds.

Figure 4:
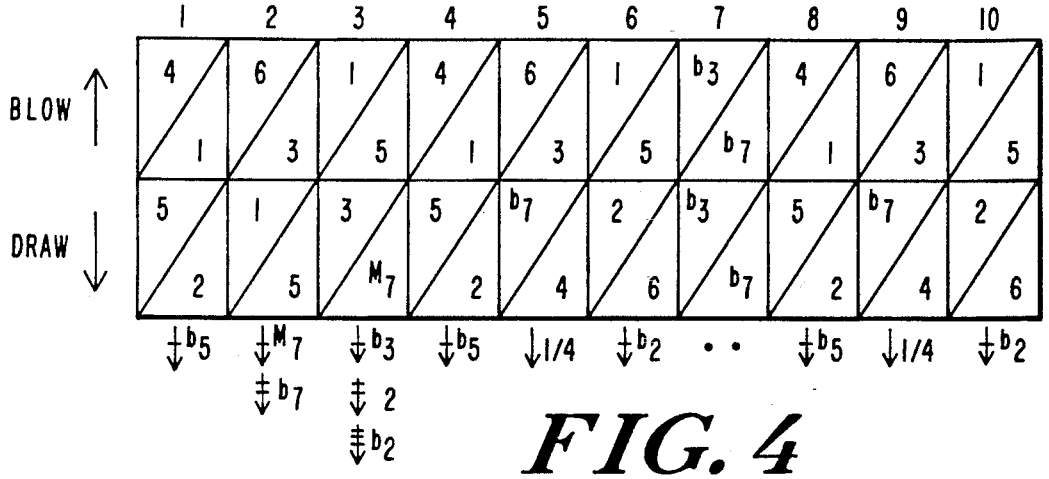

In the harmonica of FIG. 4, the draw-reed in each cavity similarly has a pitch higher than or equal to that of the blow-reed (i.e., higher in each cavity, except the seventh where the pitch of the two is the same). Therefore, the draw-reeds in the first through sixth and the eighth through tenth cavities will bend, and the blow-reeds will produce a seventh (1-3-5-$^b$7) chord. It will be noted that, except in the seventh cavity, the draw-reeds of the FIG. 4 harmonica are the same as in the conventional harmonica. In the blow-reeds, the third set of 1-3-5 reeds has been moved from the seventh through ninth cavities to the eighth through tenth cavities, and a flatted seventh note placed in the seventh cavity.

FIGS. 5–8 illustrate a number of other harmonicas constructed in accord with the present invention in which (i) the draw-reed in each cavity is higher in pitch than the blow-reed in the respective cavity and (ii) the blow-reeds will produce an extended chord of the blow key-note.

Figure 5:
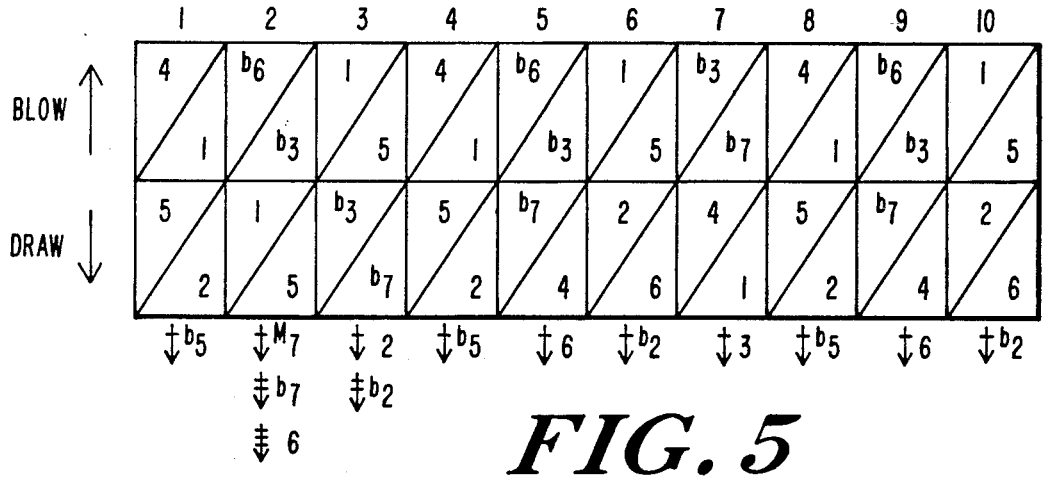

In the harmonica of FIG. 5, all the draw-reeds bend at least one-half step, and the blow-reeds in the fourth through seventh cavities will produce a minor seventh chord (i.e., 1-$^b$3-5-$^b$7). The same chord, two and one-half steps lower in pitch, is produced by the draw-reeds in the second through fifth cavities.

Figure 6:
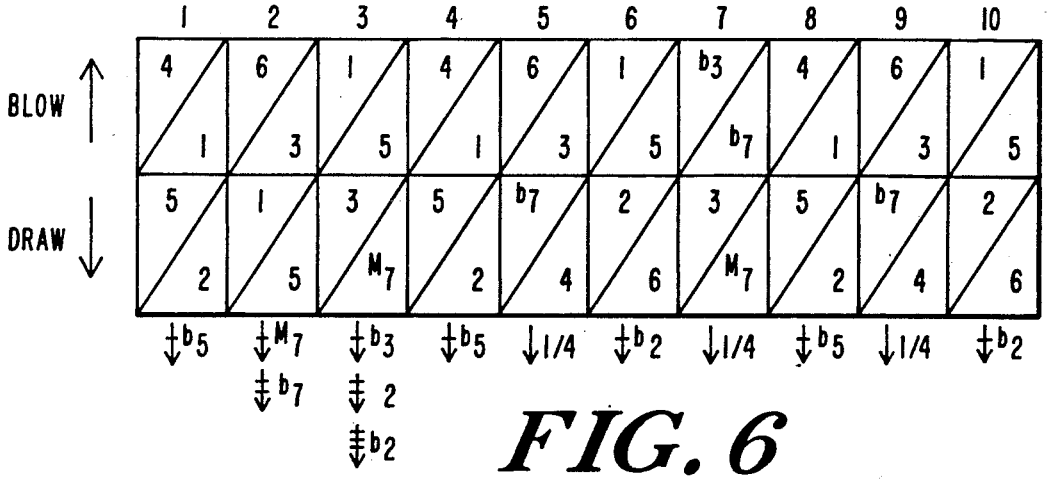

All the draw-reeds of the FIG. 6 harmonica also bend, but it will be noted that those in the fifth, seventh and ninth cavities bend only a ¼ tone. The blow-reeds in the fourth through seventh cavities will produce a seventh chord (i.e., 1-3-5-$^b$7), and the same chord, again two and one-half steps lower in pitch, is produced by the draw-reeds in the second through fifth cavities.

Figure 7:
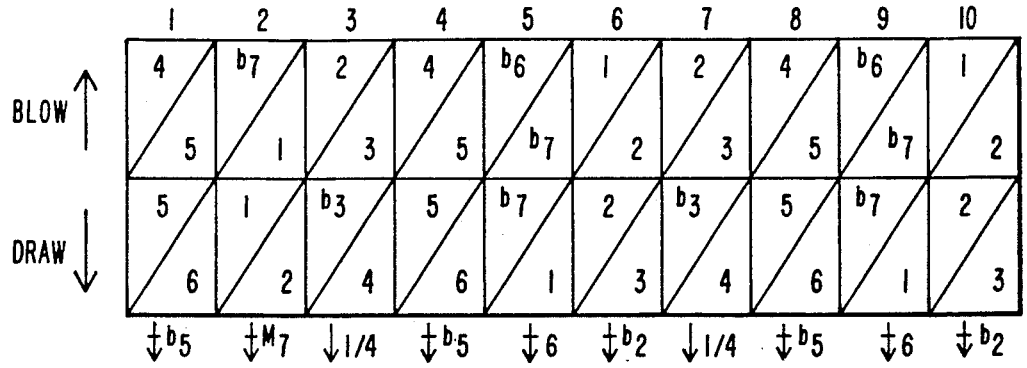

In the harmonica of FIG. 7, all the draw-reeds bend a quarter-tone or a single half step. In the second through fifth cavities, the blow reeds produce a seventh chord (1-3-5-$^b$7), and the draw-reeds produce a minor seventh chord (1-$^b$3-5-$^b$7). The key-note of the draw chord is a whole step higher in pitch than the key-note of the blow chord.

Figure 8:
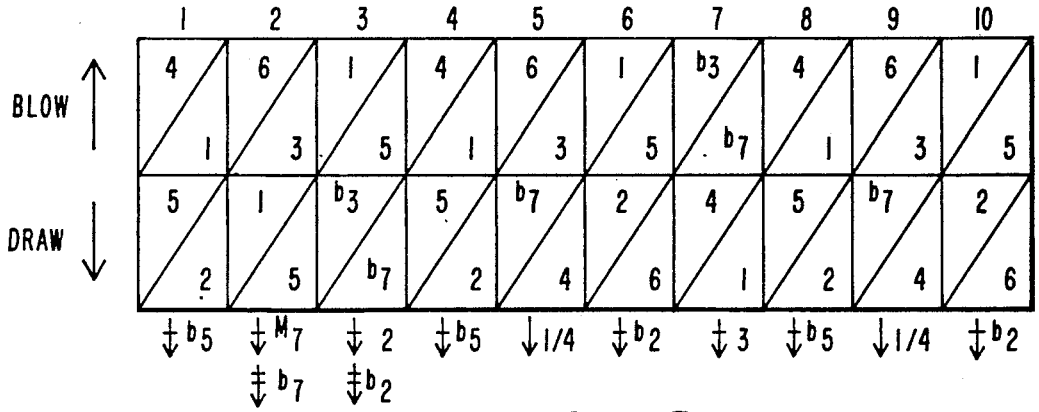

The blow-reeds of the harmonica of FIG. 8 are the same as those of the harmonica of FIG. 6. The draw-reeds are the same as those of the harmonica of FIG. 7 except that the draw-reed in the seventh cavity is 4 rather than $^b$3. All the draw-reeds bend.

Figure 9:
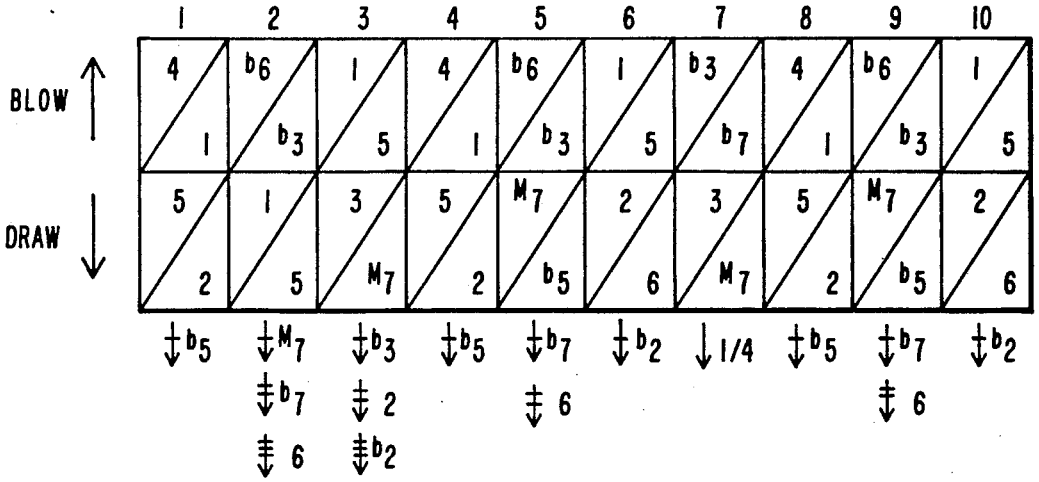

In the harmonica of FIG. 9, all the draw-reeds bend and the blow-reeds will produce a minor seventh chord (i.e., 1-$^b$3-5-$^b$7). Further, the harmonica is fully chromatic; that is the "bending" of the draw-reeds permits the reeds in any set of either three or four successive cavities to play all twelve notes of the chromatic scale, i.e., 1, $^b$2, 2, $^b$3, 3, 4, $^b$5, 5, $^b$6, 6, $^b$7 and $^M$7. Thus, and as can be seen, the six reeds in the third through fifth cavities will play a full chromatic scale starting with pitch "1" (played by the blow reed in the third cavity) and ending with pitch "$^M$7" (played by the draw-reed in the fifth cavity). In addition, the cavities below the third cavity and above the fifth cavity continue the chromatic scale in both directions. The two reeds in the second cavity play the four notes just below (i.e., $^M$7, $^b$7, 6 and $^b$6), and the next three notes above (i.e., 1, $^b$2, 2) can be played on the two reeds in the sixth cavity. The "1" note of the chromatic scale is also provided by the draw-reed in the second cavity; and viewed from this perspective the twelve notes of the chromatic scale, starting with pitch 1, are produced by the draw-reeds in the second through fifth cavities and the blow reeds in the fourth and fifth cavities. All twelve notes of the chromatic scale, often starting on notes other than "1", can be played, starting with any reed in the first six cavities or with the blow reed in the seventh cavity.

Figure 31:
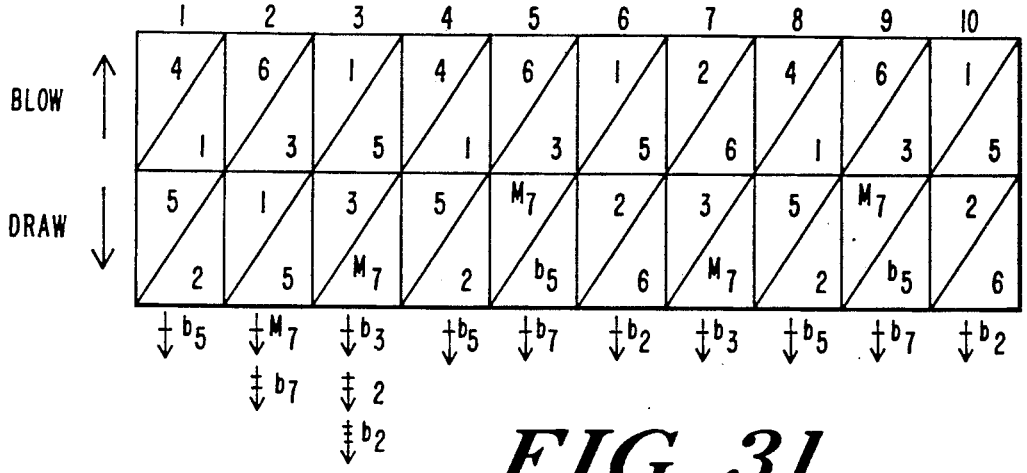

The note progression of the draw reeds in the harmonica of FIG. 31 is the same as that as in the FIG. 9 harmonica; and all the draw reeds will bend. The blow reeds differ from those of the FIG. 9 harmonica only in that the notes produced in the second, fifth, and ninth cavities are 3 rather than $^b$3, and that produced in the seventh cavity is 6 rather than $^b$7. Because of these changes, the harmonica of FIG. 31 is not fully chromatic; there is no reed that will produce $^b$6.

Figure 10:
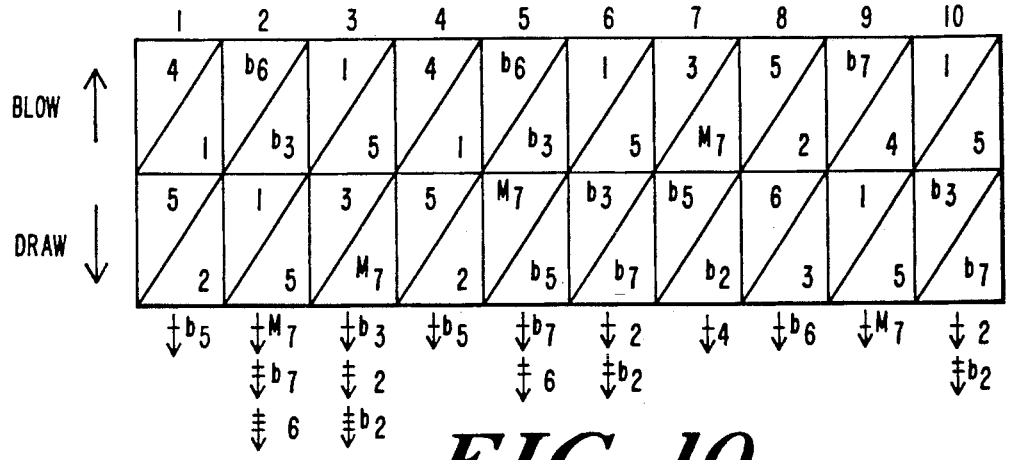

All of the draw-reeds of the harmonica of FIG. 10 also will bend. Additionally, the harmonica of FIG. 10 is fully chromatic and will produce a minor-major seventh (1-$^b$3-5-$^M$7) blow chord.

Figure 11:
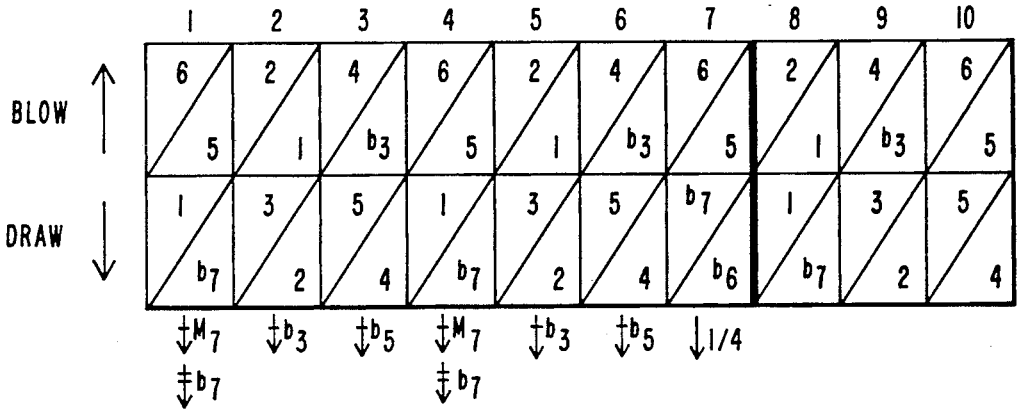

The harmonica of FIG. 11 differs from those of FIGS. 3–10 in that the draw-reeds will bend in only the first seven cavities. However, the note/reed arrangement in the FIG. 11 harmonica provides repeating 1-3-5 chords in the draw-notes, one of which is an extended chord, i.e., a seventh chord (1-3-5-$^b$7).

Figure 12:
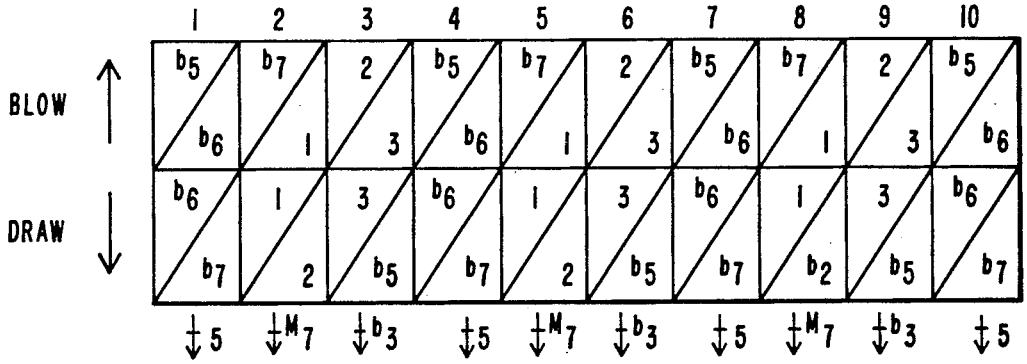

FIG. 12 shows a harmonica in which all the draw-reeds bend a single half step. Other features of the FIG. 12 harmonica are that, in their respective keys, the note progression of the drawreeds and blow-reeds are the same and both the draw-reeds and the blow-reeds produce successive augmented (e.g., 1-3-$^b$6) chords.

Figure 13:
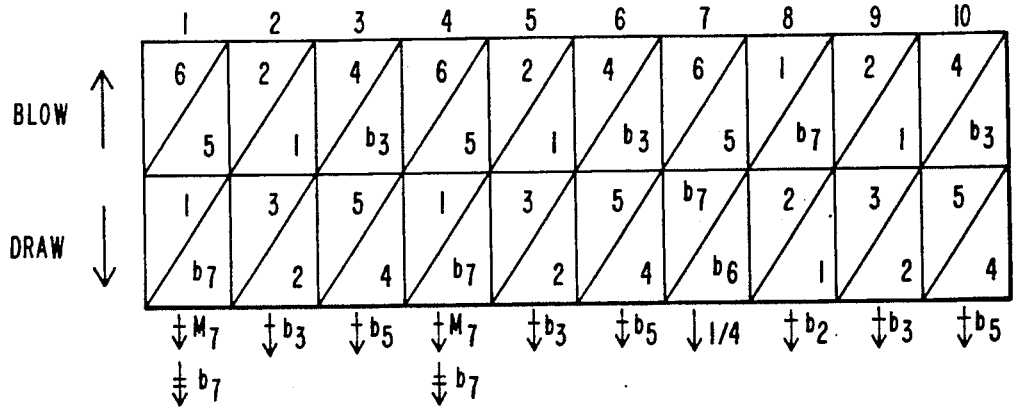
Figure 14:
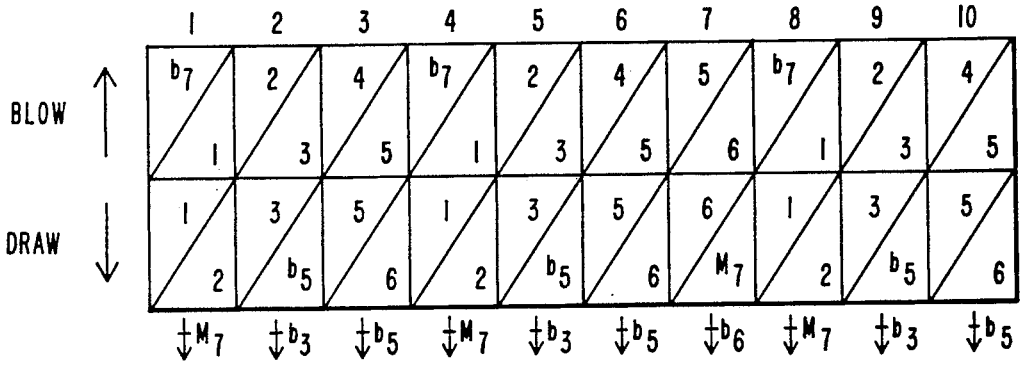

The harmonicas of FIGS. 13–14 also have their reeds so arranged that, in each cavity, the draw-reed will bend. Each also produces an extended blow chord (a minor seventh, i.e., 1-$^b$3-5-$^b$7, in FIG. 13; and a major sixth, i.e., 1-3-5-6, in FIG. 14), and repeating major (1-3-5) triad draw chords. Also, one of the draw chords (1-3-5-$^b$7 in FIG. 13 and 1-3-5-6 in FIG. 14) is extended.

FIGS. 15–18 illustrate harmonicas which, like those of FIGS. 13 and 14, include an extended blow chord (i.e., 1-3-5-6) and repeating draw chords (i.e., 1-3-5), at least one of which is extended (i.e., 1-3-5-6), and in which all the draw-reeds bend. It will also be noted that these four harmonicas differ from each other only in their voicing. That is, the draw and blow key-notes, chords and note progressions are the same, but the key-notes are placed in different cavities. The "draw" and "blow" key-notes are in the first cavity hole of the harmonica of FIG. 15, in the second cavity hole of the harmonica of FIG. 16, in the third cavity of the harmonica of FIG. 17, and in the fourth cavity of the harmonica of FIG. 18. As will be evident, this difference in "voicing" affects the chords that can be produced at the upper and lower range of the instrument.

Figure 15:
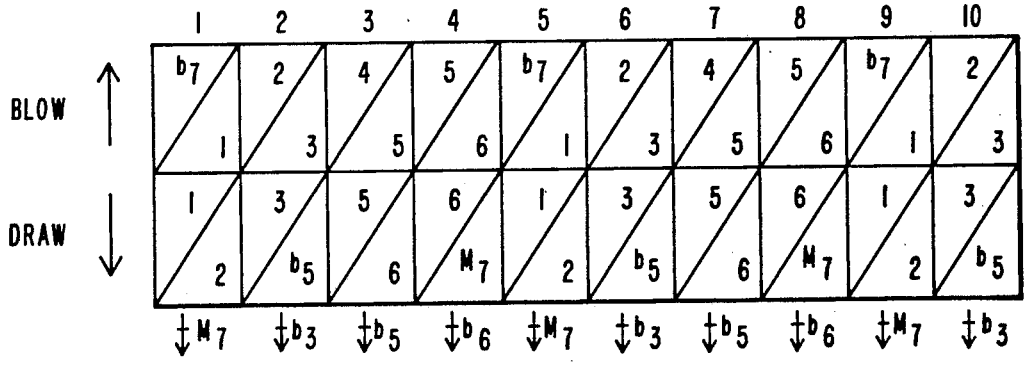
Figure 16:
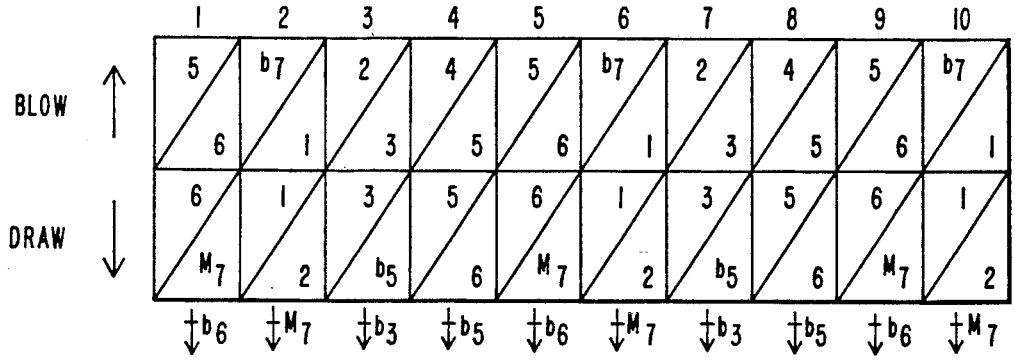
Figure 17:
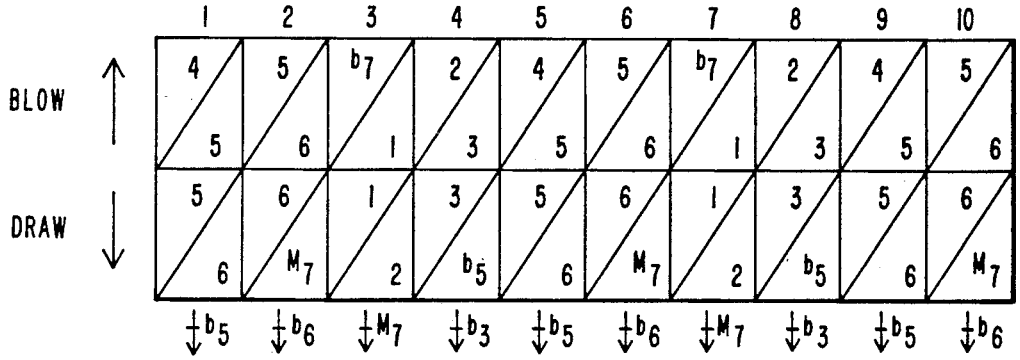
Figure 18:
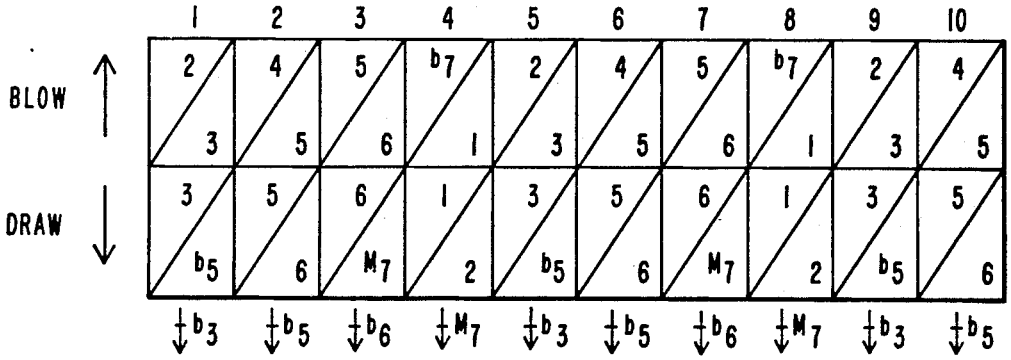
Figure 19:
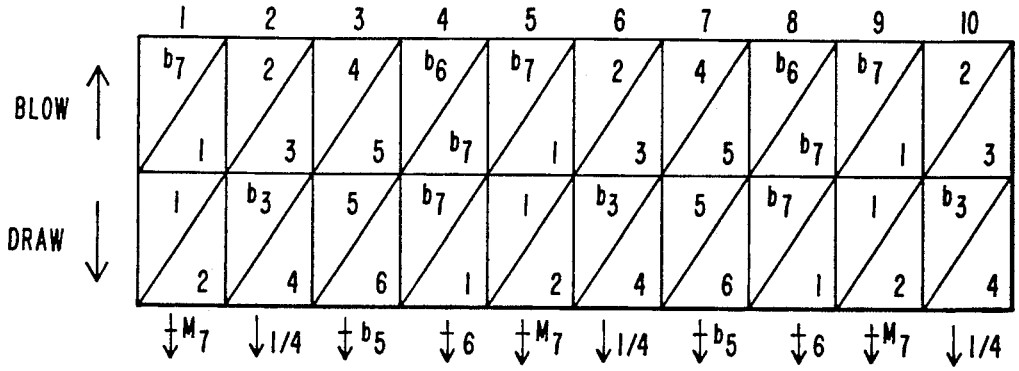

The harmonica of FIG. 19 is a variation of that of FIG. 15; the draw chords are 1-$^b$3-5-$^b$7 (rather than 1-3-5-6) and the blow chords are 1-3-5-$^b$7 (rather than 1-3-5-6). As will be evident, this change makes both the triad and extended draw chords minor, and the extended blow chords are seventh chords.

Figure 20:
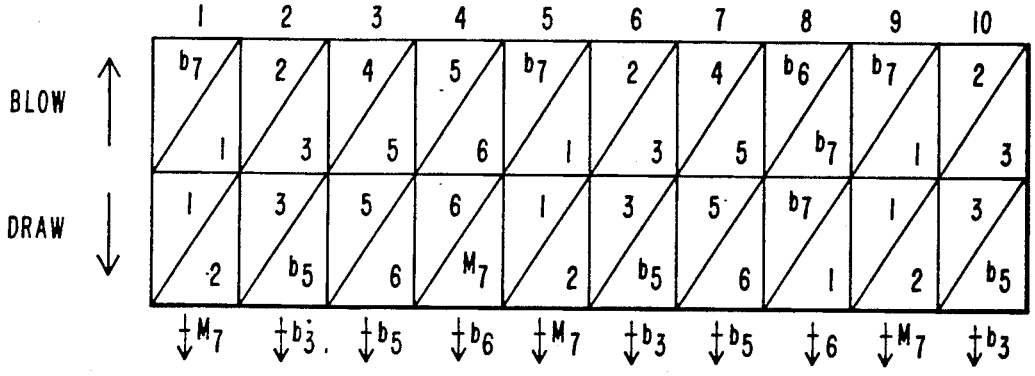

FIG. 20 shows another variation of the FIG. 15 harmonica. The harmonica of FIG. 20 is the same as that of FIG. 15, except that the draw and blow-reeds in the eighth cavity are one half step higher in pitch, i.e., the draw reed is $^b$7 rather than 6 and the blow-reed is $^b$6 rather than 5. As is evident, this changes the chord produced by the fifth through eighth cavities from 1-3-5-6 to 1-3-5-$^b$7.

Figure 21:
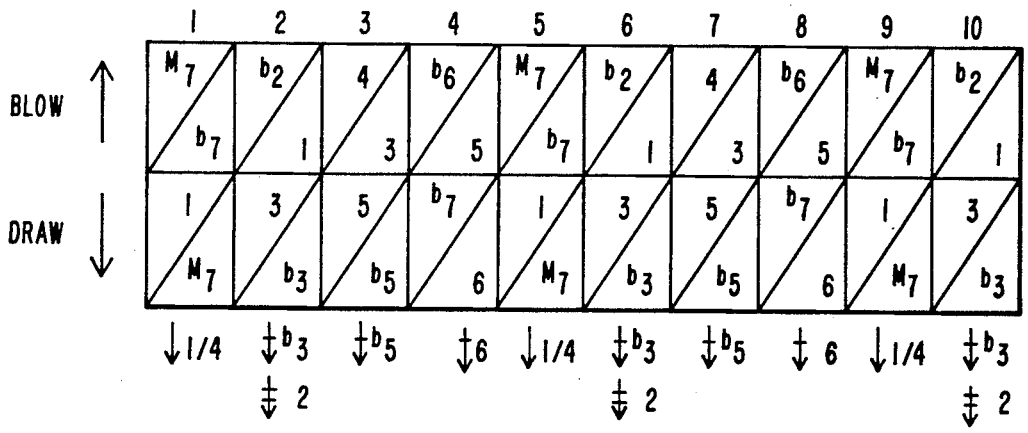

FIG. 21 shows a fully chromatic harmonica in which all the draw-reeds bend, and both the blow-reeds and draw-reeds produce repeating seventh (1-3-5-$^b$7) chords. It will be noted that, unlike the harmonicas of FIGS. 15–20 in which both the draw and blow key-notes are in the same cavity, the key-notes in the FIG. 21 harmonica are offset. The draw key-note is in the first cavity, and the blow key-note is in the second cavity.

Figure 22:
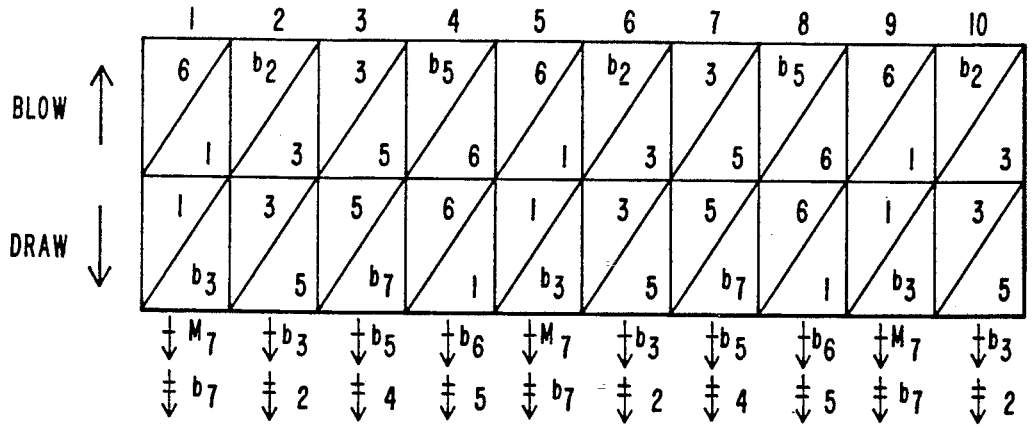
Figure 23:
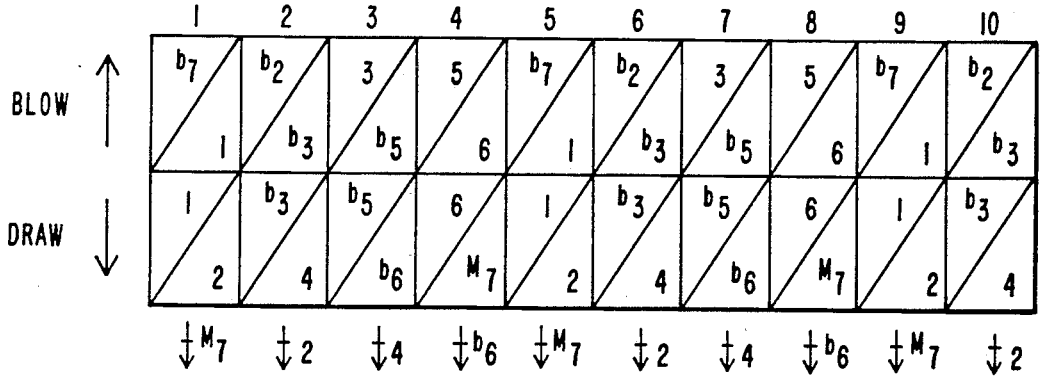

FIGS. 22–23 show fully chromatic harmonicas in which all the draw-reeds bend, and the note progressions and types of chords in both the blow and draw cavities are the same. In the FIG. 22 harmonica, each draw-reed bends two half-steps; in the harmonica of FIG. 23, each draw-reed bends a single half-step. The draw and blow key-notes of both harmonicas are in the first cavity. Both the draw and blow-reeds of the FIG. 22 harmonica produce repeating sixth (1-3-5-6) chords, based on the respective draw-and blow- key-notes; those of the FIG. 23 harmonica both produce repeating diminished seventh (1-$^b$3-$^b$5-6) chords, again based on the respective key-notes.

Figure 24:
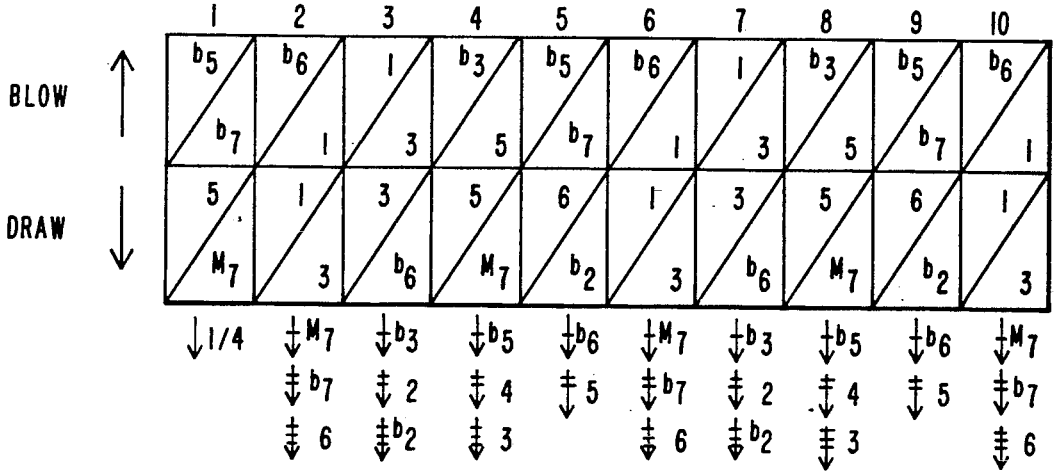
Figure 25:
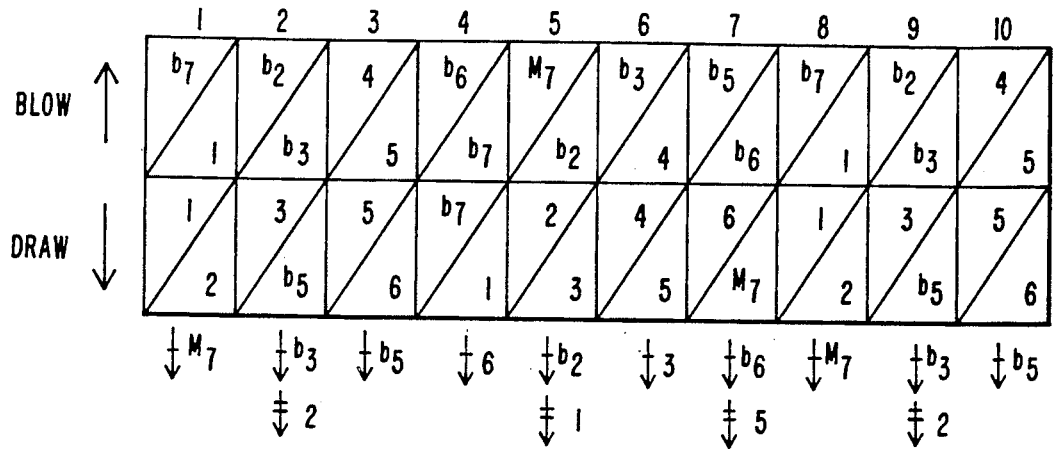
Figure 26:
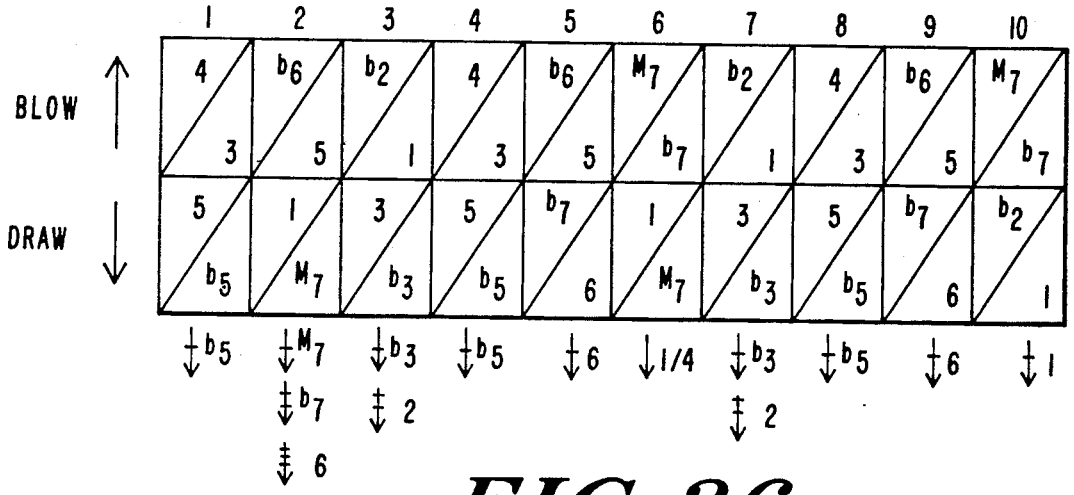

FIGS. 24–26 also illustrate fully chromatic harmonicas in which all the draw-reeds bend, which have an extended blow chord a repeating 1-3-5-$^b$7 chord in FIG. 24; a 1-$^b$3-5-$^b$7 chord in FIG. 25 and a repeating 1-3-5-$^b$7 chord in FIG. 26), and in which there are repeating (1-3-5-6 in FIG. 24; 1-3-5 in FIG. 25; and 1-3-5-$^b$7 in FIG. 26) draw chords. In the harmonicas of FIGS. 24 and 25 the blow and draw key-notes are in the same cavity (the second cavity in FIG. 24 and the first cavity in FIG. 25), while in the harmonica of FIG. 26 they are offset (the draw key-note is in the second cavity and the blow key-note is in the third cavity).

Figure 27:
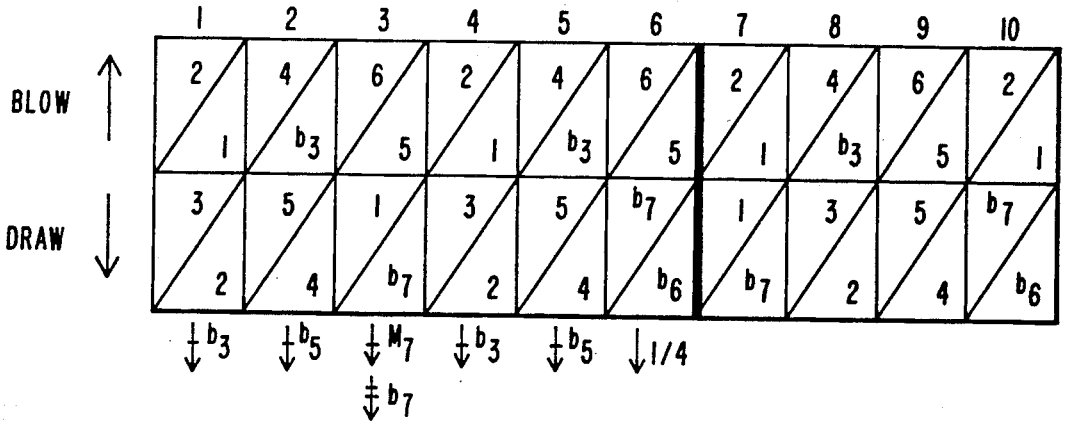
Figure 28:
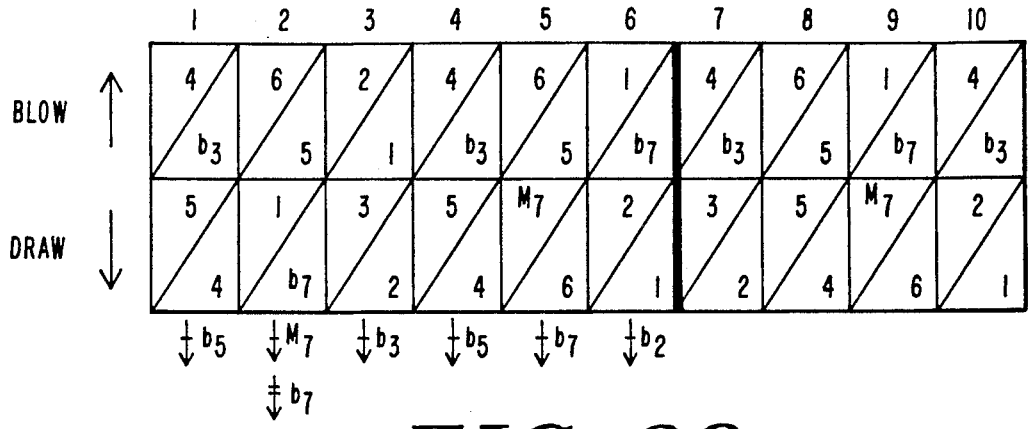
Figure 29:
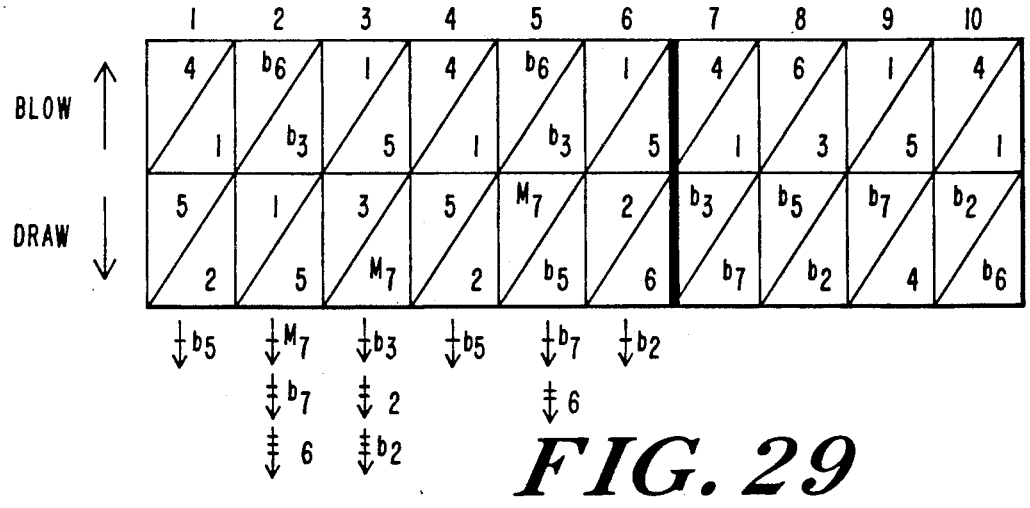

Reference is now made to FIGS. 27–29. Each illustrates a harmonica which obtains the advantage of one aspect of the present invention even though, as in a conventional harmonica, the draw-reeds bend in only six successive cavities.

The harmonica of FIG. 27 provides repeating seventh (1-3-5-$^b$7) chords in the draw-reeds and repeating minor triads (1-$^b$3-5) in the blow-reeds. As discussed above, repeating chords in the draw-reeds are provided also by the harmonicas of FIGS. 3, 11–27 and 32–35.

The harmonica of FIG. 28 provides an extended blow chord, i.e., a minor seventh (1-$^b$3-5-$^b$7) chord. Extended blow chords are provided also by the harmonicas of FIGS. 3–10, 13–26, 28, 31 and 33–35.

The harmonica of FIG. 29 is fully chromatic, as are the harmonicas of FIGS. 9, 10, and 21–26.

Figure 30:
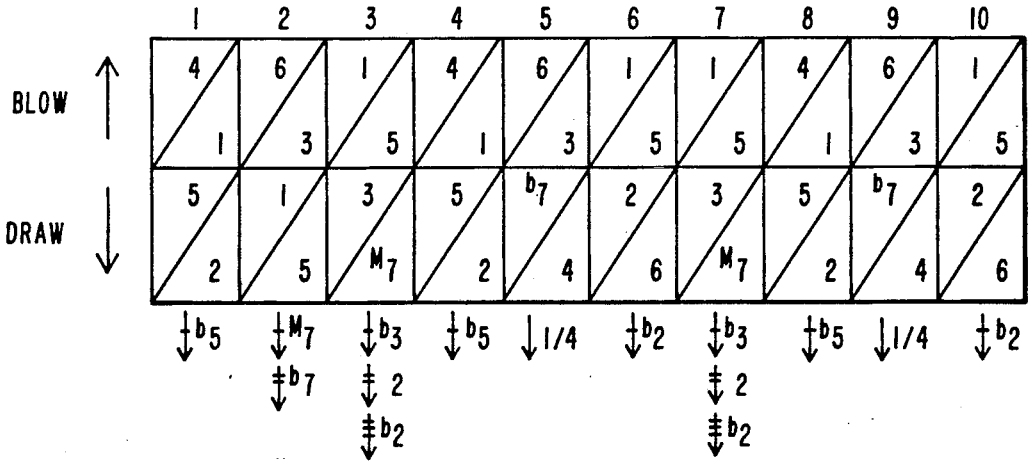

FIG. 30 illustrates a harmonica in which all the draw reeds bend, and that a person who is used to the conventional harmonica of FIGS. 1 and 2 will find very easy to play. As shown, the arrangement of the draw reeds in the harmonicas of FIG. 30 is the same as that in the harmonicas of FIGS. 1 and 2. The blow reeds in the first six cavities of the harmonica of FIG. 30 also are identical to those the first six cavities of the conventional harmonica, and those in the eighth through tenth cavities in the FIG. 30 harmonica are the same as those in the seventh through ninth cavities in the FIG. 1 and 2 harmonica. However, the blow-reed in the seventh cavity of the FIG. 30 harmonica has been changed from "1" to "5", and the next three blow reeds have been shifted one cavity to the right; therefore, and unlike the conventional harmonicas of FIGS. 1 and 2, all the draw reeds of the FIG. 30 harmonica will bend.

Figure 32:
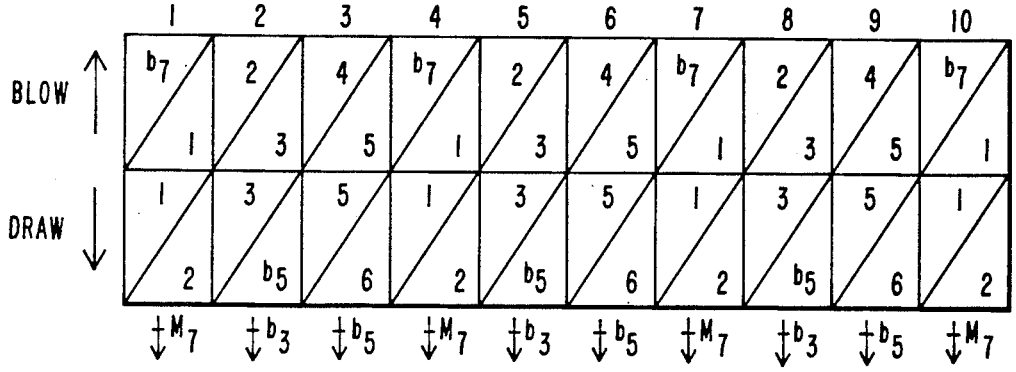

FIG. 32 discloses a harmonica in which all the draw reeds bend a half-step (i.e., in each cavity of the harmonica, the pitch of the draw reed is a whole-step higher than that of the blow reed), and in which (in their respective keys) both the draw reeds and the blow reeds have the same note progression and produce repeating 1-3-5 chords.

Figure 33:
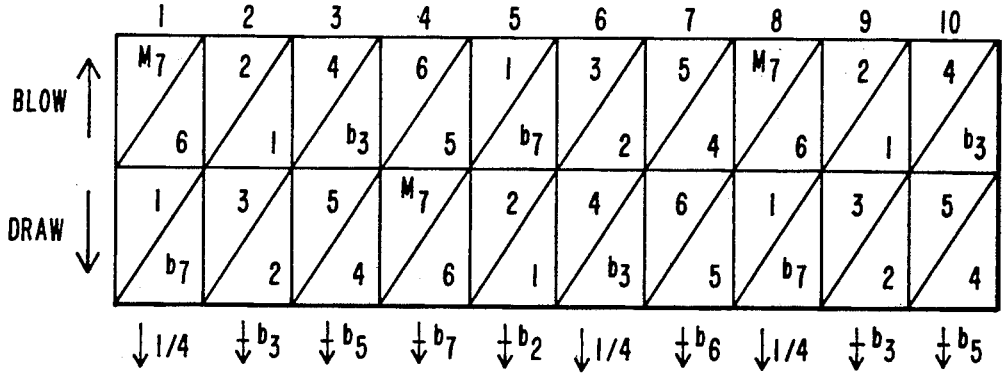
Figure 34:
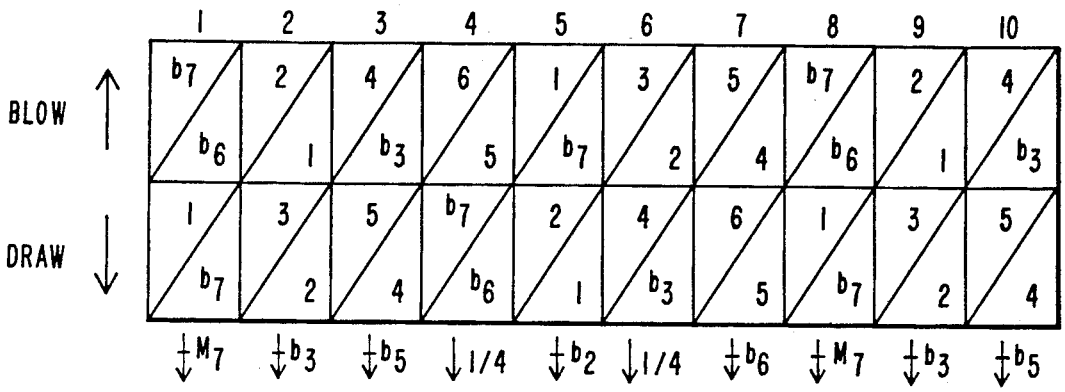
Figure 35:
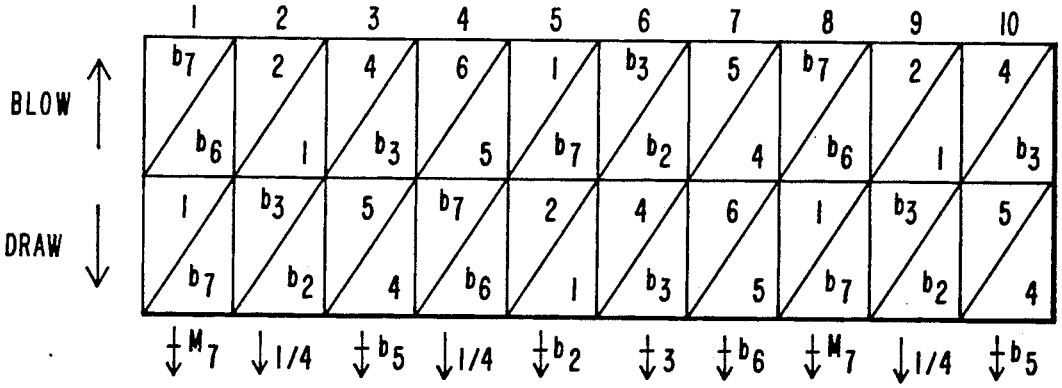

FIGS. 33 through 35 illustrate harmonicas in which any two adjacent blow-reeds or draw-reeds are either a major interval or a minor interval apart in pitch, thus permitting any set of three notes to play a harmonic chord. The reeds are also arranged so that the interval between the blow-reed and the draw-reed in any single cavity, and that between the draw-reed in any cavity and the blow-reed in the next adjacent cavity, is a single note of the scale, thus permitting the entire scale to be played in harmony. Here, it should be noted that the FIG. 33 harmonica is tuned in the scale of the Ionian mode, while those of FIGS. 34 and 35 are tuned, respectively, in the scales of the Mixolydian and Dorian modes. It also will be noted that, in each harmonica, the chord of the first four draw-reeds is repeated, one octave higher, in the blow-reeds in the fifth through eighth cavities; while the chord of the second through fifth blow-reeds is repeated by the draw-reeds in the fifth through eighth cavities. Further, all the draw-reeds in all three harmonicas bend, and in each harmonica there is an extended blow chord in the second through fifth cavities and then repeating draw chords in the first through third cavities and the eighth through tenth cavities.

Other embodiments will be within the scope of the following claims.

Some of such embodiments will include one or more of the features discussed above with respect to FIGS. 27–29, or will be constructed so that the draw-reeds in at least seven successive cavities (which cavities may or may not include the first cavity of the harmonica) have a pitch higher than or equal to the pitch of the blow-reed in the respective cavity.

Other embodiments will be slide harmonicas in which one or both of the simple harmonicas used therein are within the scope of one or more of the following claims. It should be noted that slide harmonicas are typically valved, and if so it is difficult to bend a reed more than a single half-step. It also should be noted that a slide harmonica is typically made so that, each of its "holes" overlies a cavity of each of the two simple harmonicas; and when applied to a slide harmonica, the term "cavity" refers to a cavity of one of the two simple harmonicas of which the slide harmonica is made, and "adjacent cavities" refers to adjacent cavities of one of the two simple harmonicas. As used in the claims:

i. the term "tonic chord" means a full chord produced by the reeds, responsive to the same wind direction, of three adjacent cavities of the harmonica and including the first, third (flatted or natural) and fifth (natural whether the third is flatted or natural, flatted if the third is flatted, or augmented/raised [i.e., to $\#5/^{b}6$] if the third is natural) notes of a scale (i.e., a 1-3-5, 1-$^{b}$3-5, 1-$^{b}$3-$^{b}$5 or 1-3-$\#5/^{b}6$ chord);

ii. the term "sub-dominant chord" means a full chord produced by the reeds, responsive to the same wind direction, of three adjacent cavities of the harmonica and including the fourth, sixth (flatted or natural) and eighth (natural whether the sixth is flatted or natural, flatted if the sixth is flatted, or augmented/raised [i.e., to $\#8/^{b}9$] if the sixth is natural) notes of the scale of the root note of the tonic chord (i.e., a 4-6-8/1, 4-$^{b}$6-8/1, 4-$^{b}$6-$^{b}$8/$^{M}$7, 4-6-$\#8/^{b}9$ chord);

iii. the term "dominant chord" means a full chord produced by the reeds, responsive to the same wind direction, of three adjacent cavities of the harmonica and including the fifth, seventh (flatted or major/natural) and ninth (natural whether the seventh is flatted or major/natural, flatted if the seventh is flatted or augmented/raised [i.e., to $\#9/^{b}10$] if the seventh is natural) notes of the scale of the root note of the tonic chord (i.e., a 5-$^{M}$7-9, 5-$^{b}$7-9, 5-$^{b}$7-$^{b}$9, 5-$^{M}$7-$\#9/^{b}10$ chord); and iv. the term "extended chord" means a chord produced by the reeds, responsive to the same wind direction, of at least four adjacent cavities and including a full (i.e., three note) major, minor, diminished or augmented chord and one or more different notes. In connection with the above, it should be noted that the eighth, ninth and tenth notes of a scale are, respectively, the same as the first, second and third notes, but one octave higher in pitch.

What is claimed is:

1. A harmonica including a body providing a series of adjacent cavities and a plurality of reeds each of which is responsive to the passage of air normally to produce an audible musical note of a certain predetermined pitch, a pair of said reeds being associated with each of said cavities such that one of each pair of associated reeds is a blow-reed responsive to blowing into said cavity to produce a blow-note and the other of the pair of associated reeds is a draw-reed responsive to drawing on said cavity to produce a draw-note, said harmonica being characterized in that (a) in each of at least seven adjacent cavities the predetermined pitch of the associated draw-reed is higher than the predetermined pitch of the associated blow-reed; and (b) in at least five of said seven adjacent cavities the predetermined pitch of the draw-reed is at least a whole step higher than that of the associated blow-reed.

2. The harmonica of claim 1 further characterized in that:

(a) the draw-reeds are arranged to produce a tonic chord and a dominant chord; and, (b) the blow-reeds are arranged to produce a sub-dominant chord.

3. The harmonica of claim 2 further characterized in that in each of at least ten adjacent cavities the predetermined pitch of the associated draw-reed is higher than the predetermined pitch of the associated blow-reed.

4. The harmonica of claim 2 further characterized in that the blow-reeds associated with four adjacent cavities are arranged to produce an extended blow chord.

5. The harmonica of claim 2 further characterized in that the draw-reeds of two sets of three adjacent cavities thereof produce the same chord.

6. The harmonica of claim 5 further characterized in that one of said two sets includes four adjacent cavities and the draw-reeds of said one of said two sets produce an extended chord.

7. The harmonica of claim 6 further characterized in that each of said two sets includes four adjacent cavities and the draw-reeds of each of said two sets produce an extended chord including said same chord.

8. The harmonica of claim 5 further characterized in that (i) said sub-dominant chord is an extended chord and is produced by the blow-reeds associated with four adjacent cavities, and (ii) the blow reeds and the draw reeds in respective sets of four adjacent cavities thereof both produce respective extended chords.

9. The harmonica of claim 8 wherein the blow-reeds and the draw-reeds thereof both produce respective repeating chords, and each of said repeating chords is extended and is produced by the reeds in a set of four adjacent cavities.

10. The harmonica of claim 5 further characterized in that the blow-reeds associated with four adjacent cavities are arranged to produce an extended chord.

11. The harmonica of claim 2 wherein in each of the cavities thereof the pitch interval between the blow-reed and the draw-reed is a single note of the scale of the mode in which the harmonica is tuned, and the pitch interval between the draw-reed in any cavity and the blow-reed in the next higher cavity is a said single note.

12. The harmonica of claim 2 wherein the predetermined pitch of the draw-reed is at least a whole step higher than that of the blow-reed in all of said seven adjacent cavities.

13. The harmonica of claim 12 wherein the predetermined pitch of the draw-reed is at least a whole step higher than that of the blow-reed in all cavities of the harmonica.

14. The harmonica of claim 2 wherein said harmonica is characterized in that the notes produced by the said draw-reeds and the said blow-reeds in at least six of said seven adjacent cavities are related in the same manner as are the notes produced by the draw-reeds and blow-reeds in a set of at least six adjacent cavities of the harmonica of one of FIGS. 5–9, 13, 26, 30, 31, and 33–35.

15. The harmonica of claim 1 further characterized in that the draw-reeds of at least three sets of three adjacent cavities thereof produce the same chord.

16. The harmonica of claim 1 wherein the blow-reeds and the draw-reeds thereof produce respective repeating chords and the key notes of said chords are in the same cavity.

17. The harmonica of claim 1 further characterized in that:

(a) in any two adjacent ones of said seven adjacent cavities the interval in pitch between the blow-reeds is either 1½ steps or 2 steps, and the interval in pitch between the draw-reeds is either 1½ steps or 2 steps; and, (b) the pitch interval between a draw-reed in any one of the six lowest pitched of said seven adjacent cavities and the blow-reed in the next highest pitched adjacent cavity is a single note of a modal scale.

18. The harmonica of claim 17 wherein the draw-reeds of a first set of four adjacent cavities produce a chord which is repeated, one octave higher in pitch, by the blow-reeds of a second set of four adjacent cavities, said first and second sets being adjacent to each other.

19. The harmonica of claim 18 wherein the blow-reeds of a third set of four adjacent cavities produce a chord which is repeated, one octave higher in pitch, by the draw-reeds of a fourth set of four adjacent cavities, said third and fourth sets having at least one cavity in common.

20. The harmonica of claim 1 further characterized in that it has at least six adjacent cavities in which the notes produced by the said draw-reeds and blow-reeds are related in pitch in the same manner as are the notes produced by the draw-reeds and blow-reeds in the second through seventh cavities of the harmonica of one of FIGS. 5–6, 8–9, 11, 13, 15–19, 21, 26 and 31, or in the first six cavities of the harmonica of FIG. 7.

21. The harmonica of claim 20 wherein said harmonica is characterized in that it has at least ten adjacent cavities in which the notes produced by the said draw-reeds and blow reeds are related in the same manner as are the notes produced by the draw reeds and blow-reeds of the harmonica of one of FIGS. 5–6, 8–9, 15–18, 26 and 31.

22. The harmonica of claim 1 further characterized in that the note progression of the blow reeds in a set of at least seven adjacent cavities is the same as the note progression of the draw-reeds in a set of at least seven adjacent cavities, said sets of cavities having at least six cavities in common.

23. A harmonica including a body providing a series of adjacent cavities and a plurality of reeds each of which is responsive to the passage of air normally to produce an audible musical note of a certain predetermined pitch, a pair of said reeds being associated with each of said cavities such that one of each pair of associated reeds is a blow-reed responsive to blowing into said cavity to produce a blow-note and the other of the pair of associated reeds is a draw-reed responsive to drawing on said cavity to produce a draw-note, said harmonica being characterized in that in at least seven adjacent cavities the note progression in the blow-reeds and the draw-reeds thereof is the same, the pitch of a draw-reed in any of said seven cavities being at least two half steps higher than the pitch of the blow-reed in the said cavity.

24. The harmonica of claim 23 further characterized in that (i) the blow-reeds associated with four adjacent cavities are arranged to produce an extended chord, and (ii) the draw-reeds of at least two sets of three adjacent cavities thereof produce the same draw chord.

25. A harmonica including a body providing a series of adjacent cavities and a plurality of reeds each of which is responsive to the passage of air normally to produce an audible musical note of a certain predetermined pitch, a pair of said reeds being associated with each cavity such that one of each pair is a blow-reed responsive to blowing into such cavity to produce a blow-note and the other of each pair is a draw-reed responsive to drawing on said cavity to produce a draw-note, said harmonica being characterized in that in each of at least seven adjacent cavities the predetermined pitch of the associated draw-reed is higher than the predetermined pitch of the associated blow-reed, said pitch of said draw-reed being at least a whole step higher than said pitch of aid blow-reed in at least five of said seven cavities, and the reeds in a set of not more than four adjacent cavities are arranged to produce all twelve notes of a chromatic scale.

26. The harmonica of claim 25 wherein the reeds in any set of four adjacent ones of said at least seven adjacent cavities are arranged to produce all twelve notes of a chromatic scale.

27. The harmonica of claim 26 wherein the reeds in at least one set of three adjacent cavities are arranged to produce all twelve notes of a chromatic scale.

28. The harmonica of claim 27 wherein the reeds in each of a plurality of sets of four adjacent cavities are arranged to produce all twelve notes of a chromatic scale.

29. The harmonica of claim 25 further characterized in that (i) the blow-reeds associated with four adjacent cavities are arranged to produce an extended chord, (ii) the draw-reeds of at least two sets of three adjacent cavities thereof produce the same chord, and (iii) the reeds in each of a plurality of sets of four adjacent cavities thereof are arranged to produce all twelve notes of a chromatic scale.

30. The harmonica of claim 29 wherein the blow-reeds and the draw-reeds thereof both produce respective repeating extending chords.

31. The harmonica of claim 30 wherein the key-notes of said chords are in the same cavity.

32. The harmonica of claim 25 further characterized in that said body provides a series of at least ten adjacent cavities and the reeds in any set of five adjacent ones of said at least ten cavities are arranged to produce all twelve notes of a chromatic scale.

33. A harmonica including a body providing a series of adjacent cavities and a plurality of reeds each of which is responsive to the passage of air normally to produce an audible musical note of a certain predetermined pitch, a pair of said reeds being associated with each of said cavities such that one of each pair of associated reeds is a blow-reed responsive to the blow wind direction to produce a blow-note and the other of the pair of associated reeds is a draw-reed responsive to the draw wind direction to produce a draw-note, said harmonica being characterized in that:

(a) in at least seven adjacent cavities the predetermined pitches of the reeds responsive to one of said wind directions are at least a half step higher but not more than two whole steps higher than the predetermined pitches of the associated reeds responsive to the other of said wind directions; and, (b) in at least five of said seven cavities the difference in pitch between the two reeds associated with the said cavity is at least a whole step.

34. The harmonica of claim 33 further characterized in that the reeds of a set of not more than four adjacent cavities are arranged to produce all twelve notes of a chromatic scale.

35. The harmonica of claim 33 further characterized in that the note progression of the reeds responsive to one of said wind directions in a set of at least seven adjacent cavities is the same as the note progression of the reeds responsive to the other of said wind directions in a set of at least seven adjacent cavities, said sets of cavities having at least six cavities in common.

36. The harmonica of claim 35 further characterized in that said sets have at least seven cavities in common and in each of said seven cavities of said sets the pitch of the respective reed responsive to one of said wind directions is at least two half-steps higher than the pitch of the reed responsive to the other of said wind directions.

37. The harmonica of claim 33 further characterized in that:

(a) in any two adjacent ones of said adjacent cavities, the pitch between the reeds responsive to one of said wind directions is either 1½ or 2 steps, and the interval between the reeds responsive to the other of said wind directions is either 1½ or 2 steps; and, (b) the pitch interval between a reed responsive to one of said wind directions in any of the six lowest pitched of said seven adjacent cavities and the reed responsive to the other of said wind direction in the next highest pitched adjacent cavity is a single note of a scale.

38. The harmonica of claim 33 further characterized in that:

(a) the reeds responsive to one of said wind directions are arranged to produce a tonic chord and a dominant chord; and, (b) the reeds responsive to the other of said wind directions are arranged to produce a sub-dominant chord.

39. The harmonica of claim 33 further characterized in that (i) the blow reeds thereof in each of three separate sets of three adjacent cavities produce the same blow chord, and (ii) the draw reeds thereof in each of three separate sets of three adjacent cavities produce the same draw chord.

40. The harmonica of claim 39 further characterized in that the said blow reeds that produce said blow chords are in nine adjacent cavities, and the said draw reeds that produce said draw chords are in nine adjacent cavities.

* * * * *